US012516523B2

(12) United States Patent
Jacqus et al.

(10) Patent No.: US 12,516,523 B2
(45) Date of Patent: Jan. 6, 2026

(54) SOUND INSULATING ELEMENT AND A SUSPENDED CEILING SYSTEM

(71) Applicant: SAINT-GOBAIN ECOPHON AB, Hyllinge (SE)

(72) Inventors: Gary Jacqus, Villeneuve sur Fere (FR); Volodymyr Iurasov, Fontainebleau (FR); Benjamin Sourcis, Paris (FR)

(73) Assignee: SAINT-GOBAIN ECOPHON AB, Hyllinge (SE)

( * ) Notice: Subject to any disclaimer, the term of this patent is extended or adjusted under 35 U.S.C. 154(b) by 210 days.

(21) Appl. No.: 18/264,961

(22) PCT Filed: Feb. 10, 2022

(86) PCT No.: PCT/EP2022/053275
§ 371 (c)(1),
(2) Date: Aug. 10, 2023

(87) PCT Pub. No.: WO2022/175163
PCT Pub. Date: Aug. 25, 2022

(65) Prior Publication Data

US 2024/0117631 A1 Apr. 11, 2024

(30) Foreign Application Priority Data

Feb. 19, 2021 (EP) ..... 21158160

(51) Int. Cl.
*E04B 9/00* (2006.01)

(52) U.S. Cl.
CPC ..... *E04B 9/001* (2013.01)

(58) Field of Classification Search
CPC ..... E04B 9/001; E04B 9/0464; E04B 9/0457; E04B 9/0485; E04B 9/06; E04B 9/18; E04B 1/86; E04B 1/8409; E04B 2001/848; E04B 2001/8485; E04B 2001/849;
(Continued)

(56) References Cited

U.S. PATENT DOCUMENTS 3,153,304 A * 10/1964 Evangelista ..... E04B 9/001 52/778
3,177,970 A * 4/1965 Boschi ..... F16L 55/02 181/290
(Continued)

FOREIGN PATENT DOCUMENTS

GB 822954 A 11/1959
RU 172 121 U1 6/2017
WO WO 2013/184370 A2 12/2013

OTHER PUBLICATIONS

Translation of RU172121 (Year: 2017).*
(Continued)

*Primary Examiner* — Jessica L Laux
(74) *Attorney, Agent, or Firm* — Oblon, McClelland, Maier & Neustadt, L.L.P.

(57) ABSTRACT

A sound insulating element includes a single body made of a mineral fibre material having acoustically insulating properties, the body including a front surface, a rear surface and a side surface connecting the front and rear surfaces. A suspended ceiling system to be suspended from a structural ceiling includes a plurality of ceiling tiles, and at least one of the ceiling tiles is a sound insulating element.

16 Claims, 3 Drawing Sheets

(58) Field of Classification Search
CPC ..... E04B 2001/8457; E04B 2001/8476; E04B 2001/8423; E04B 2001/8433
See application file for complete search history.

(56) References Cited

U.S. PATENT DOCUMENTS

| | | | | | |
|---|---|---|---|---|---|
| 3,351,154 | A * | 11/1967 | Kodaras | E04B 9/0464 | 52/145 |
| 5,024,290 | A * | 6/1991 | Birker | E04B 1/86 | 181/293 |
| 6,108,994 | A * | 8/2000 | Bodine | E04B 9/067 | 52/506.07 |
| 6,244,378 | B1 * | 6/2001 | McGrath | G10K 11/172 | 428/116 |
| 8,579,079 | B2 * | 11/2013 | Beauvilain | B64C 1/40 | 181/290 |
| 2002/0195723 | A1 * | 12/2002 | Collette | H01L 24/05 | 257/784 |
| 2009/0173569 | A1 * | 7/2009 | Levit | E04B 1/8409 | 181/290 |
| 2011/0186380 | A1 | 8/2011 | Beauvilain et al. | | |
| 2015/0090526 | A1 | 4/2015 | Sasaki | | |

OTHER PUBLICATIONS

Translation of abstract of RU172121 (Year: 2017).*
International Search Report issued May 2, 2022 in PCT/EP2022/053275, filed on Feb. 10, 2022, 4 pages.
European Office Action issued Jul. 25, 2025, in European Patent Application No. 21158160.8, 6 pages.

* cited by examiner

SOUND INSULATING ELEMENT AND A SUSPENDED CEILING SYSTEM

FIELD OF THE INVENTION

The present invention relates to the field of acoustics and to providing improved acoustics and sound insulation in a building space. More specifically, the present invention relates to a sound insulating element and to a suspended ceiling system comprising a sound insulating element.

BACKGROUND ART

Sound insulating elements may be used in order to improve the acoustical characteristics of a room. These are commonly formed as ceiling tiles and are used in suspended ceiling systems.

Suspended ceiling systems provides an efficient and convenient way of achieving a functional and aesthetically pleasing interior ceiling. Suspended ceiling systems may, in addition to the acoustic functionality, facilitate hiding building equipment such as ventilation ducts and electrical wiring etc. Often are the ceiling tiles in the suspended ceiling system supported by a grid of profiles which is in turn suspended from a structural ceiling in the building.

The sound insulating elements may be configured differently depending on the intended use of the space over which they are mounted. A space intended for meetings may require different acoustic properties than a room intended for giving lectures, as an example.

Manufacturers of suspended ceiling systems and of ceiling tiles are constantly striving to develop new sound insulating elements which can improve and/or allow better control of the acoustical properties thereof.

SUMMARY OF THE INVENTION

In view of that stated above, the object of the present invention is to provide a sound insulating element that mitigates some of the problems with prior art solutions. Moreover, it is an object to provide a suspended ceiling system comprising such a sound insulating element.

To achieve at least one of the above objects and also other objects that will be evident from the following description, a sound insulating element and a suspended ceiling system is provided according to the teachings herein.

More specifically, there is provided a sound insulating element comprising a single body having sound insulating properties. The body comprising a front surface, a rear surface and a side surface connecting the front and rear surfaces. The sound insulating element further comprises a plurality of acoustic resonators distributed in a rear surface portion of the body or over the rear surface of the body. Each resonator is configured to have a resonance frequency essentially corresponding to a compressional wave frequency of the body. The compressional wave frequency may negatively affect the sound insulating properties of the body of the sound insulating element, this negative effect can be remedied by the provision of acoustic resonators which have a resonance frequency corresponding to the compressional wave frequency of the body.

The sound insulating properties of the sound insulating element can thus be improved, the acoustic resonators facilitate improvement of frequency ranges in which the body of the sound insulating element may suffer from inherent decreases in sound insulating ability.

The constraints on the shape and material of the body of the sound insulating element is thus also lessened, as the acoustic resonators can compensate to some degree for reductions in performance in sound insulation of the body which may occur due to the shape or material thereof. It is thus facilitated that the sound insulating element can be provided with a body with more varied shapes and material compositions while providing satisfactory sound insulating properties.

The plurality of acoustic resonators may have a mass inclusion rate between 5% to 30% in relation to a mass of the body. Such a mass inclusion rate, which is defined as the relationship between the combined mass of the acoustic resonators and the body, has been shown to provide satisfactory improvements in the sound insulating properties of the sound insulating element.

The plurality of acoustic resonators may further be evenly distributed. The even distribution of acoustic resonators facilitates that each local resonance in the body of the acoustic insulating element can be affected by the acoustic resonators, thus improving insulating performance.

The plurality of acoustic resonators may be made of an elastomeric material such as silicone rubber or of a mineral fibre material such as glass wool. Other materials are naturally also conceivable; however, the aforementioned materials provide benefits in terms of providing acoustic resonators that are easy to produce and which provides a light and compact structure to the sound insulating element.

The body may be made of a fibre material such as mineral fibre material or from wood wool.

Each of the plurality of acoustic resonators may further have a cylindrical or cuboid shape, facilitating production of the acoustic resonators and of the sound insulating element.

Each of the plurality of acoustic resonators may have an elongate cuboid shape such that the plurality of acoustic resonators forms lamellas distributed in the rear surface portion of the body or over the rear surface of the body.

The plurality of acoustic resonators may be arranged on a layer attached to the rear surface of the body, facilitating arranging the acoustic resonators on the body of the sound insulating element. Moreover, acoustic resonators may thus be provided to ceiling tiles which are already arranged in a suspended ceiling system, as an aftermarket addition for instance. This may be beneficial in surroundings where it is noted that more sound insulation is needed, whereby a layer comprising acoustic resonators can be provided to the body of the affected ceiling tiles to form sound insulating elements.

The plurality of acoustic resonators may further be attached to the body by means of an adhesive.

Each of the plurality of acoustic resonators may have a resonance frequency in the range of 100 Hz to 2500 Hz, preferably 300 Hz to 2500 Hz.

In a second aspect is a suspended ceiling system provided. The suspended ceiling system being configured to be suspended from a structural ceiling and comprising a plurality of ceiling tiles. At least one ceiling tile is a sound insulating element according to the first aspect. A suspended ceiling system that facilitates providing improved sound insulation can thus be provided.

The suspended ceiling system may further comprise a grid of profiles supporting the plurality of ceiling tiles, the grid of profiles facilitating suspending the ceiling tiles from the structural ceiling.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
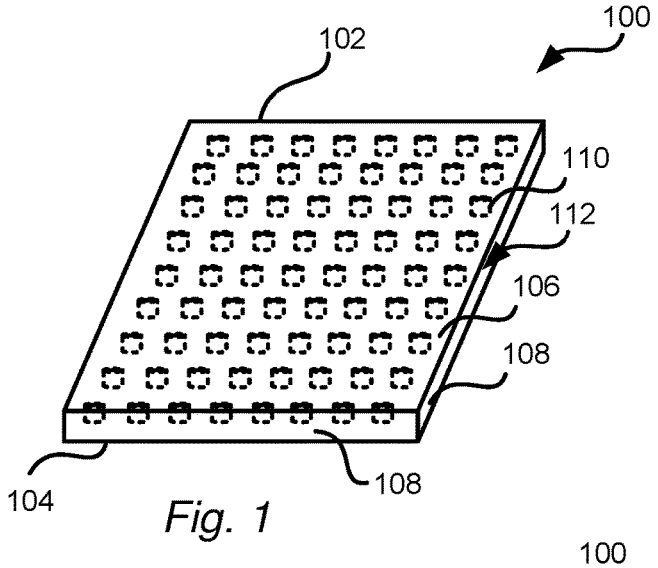
FIG. 1 discloses a perspective view of a sound insulating element.

FIG. 1 discloses a sound insulating element 100 shown in a perspective view. The sound insulating element 100 is preferably formed as a ceiling tile but may also be formed as a panel that is intended to be mounted on wall.

The sound insulating element 100 comprises a single body 102 which forms the structural main portion of the element 100. The body 102 comprises a front surface 104, a rear surface 106 and a side surface 108 connecting the front 104 and rear 106 surfaces. The front surface 104 is intended to be arranged facing the room over which the sound insulating element 100 is arranged, while the rear surface 106 is opposite the front surface 104. The sound insulating element 100 is shown having a rectangular shape but the teachings herein are not limited to rectangular sound insulating elements 100, it may just as well be circular or triangular etc.

The body 102 is preferably a monolayer structure providing the main sound insulating properties of the sound insulating element 100. Monolayer in the present disclosure should be interpreted as the body 102 being homogenously formed. It does however not exclude, as is mentioned below, that the body 102 may be provided with acoustic resonators 110 as taught in embodiments of the present disclosure.

The body 102 is made of a mineral fibre material such as glass or stone wool.

Figure 8:
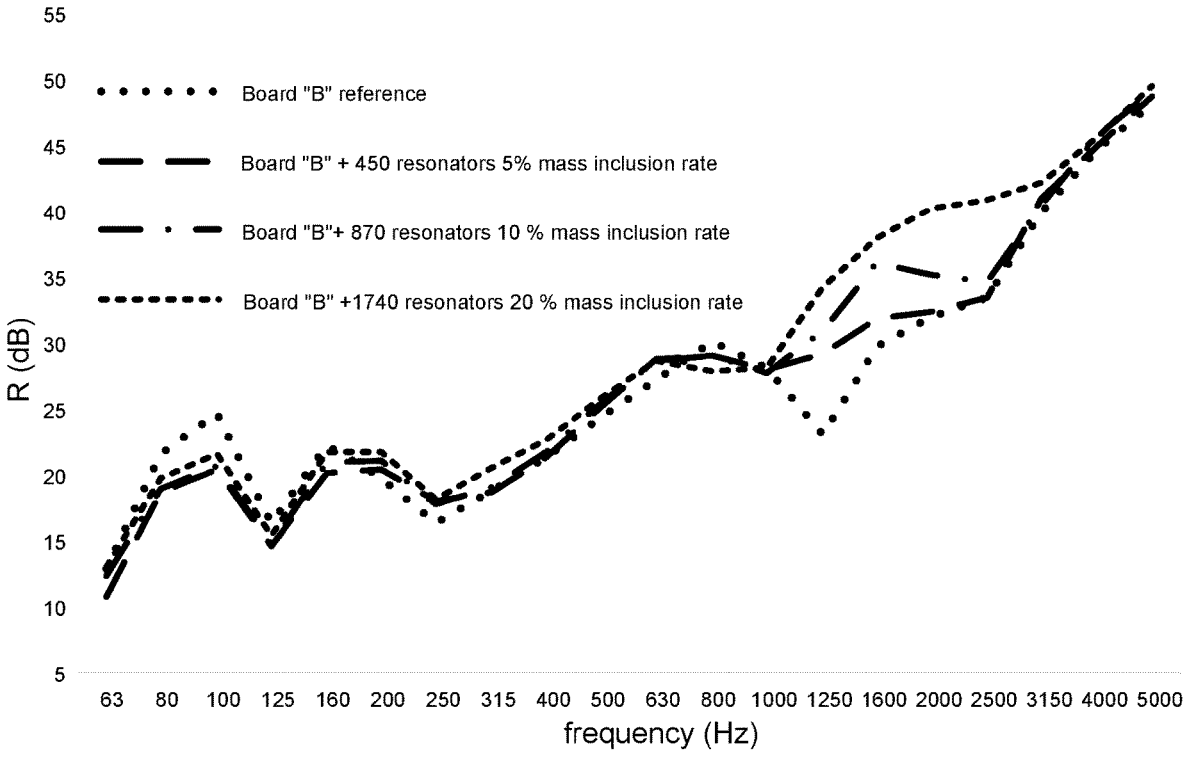
FIG. 8 discloses a diagram of measured sound reduction index R(dB) over a frequency spectrum between 50 Hz and 5000 Hz in a controlled environment for three different sound insulating elements compared to a prior art reference board B.

Typically, prior art ceiling tiles being made from a similar porous material as the body 102 of the present invention but without being provided with acoustic resonators 110 according to the teachings herein, generally may provide an inconsistent performance in terms of sound insulation over an acoustic frequency range. This is illustrated in FIG. 8 in which a prior art ceiling tile is compared to different embodiments of the sound insulating element 100 disclosed herein, where the body 102 is provided with acoustic resonators 110. FIG. 8 shows a diagram over measured sound reduction index R(dB) over a frequency spectrum between 50 Hz and 5000 Hz. As is illustrated by the line for the reference prior art board B (i.e. prior art ceiling tile) without acoustic resonators, it suffers from a reduced performance in the frequency region between the 800 Hz and 2000 Hz, as is illustrated by the decrease in R(dB) in this region.

The performance drop is due to a compressional wave resonance in the prior art ceiling tile, more specifically in the body thereof. The resonance, which is independent of the transverse dimensions of the element, improves energy transfer through the body of the ceiling tile and thus decreases the sound insulation performance. The ceiling tile may suffer from several such compressional wave resonance modes throughout its body. The precise compressional wave resonance frequency for a specific element such as a ceiling tile body is primarily dependent on thickness and stiffness thereof, and may thus vary accordingly.

The teachings herein provide a way by which the sound reduction R(dB) of a body 102 of a sound insulating element 100, and thus the sound insulation properties thereof, can be controlled to mitigate similar decreases in performance in an acoustic frequency spectrum.

The sound insulating element 100 provided herein is thus provided with a plurality of acoustic resonators 110 which allows control of the sound insulating properties of the sound insulating element 100, particularly with respect to the acoustical properties of the body 102 thereof. The plurality of acoustic resonators 110 are distributed in a rear surface portion 112 of the body 102 or over the rear surface 106 of the body 102. In the embodiment shown in FIG. 1, the acoustic resonators 110 are integrated into the rear surface portion 112 of the body 102.

The rear surface portion 112 of the body 102 is to be considered as a portion of the body 102 which is near the rear surface 106 thereof.

The acoustic resonators 110 may exhibit material properties which differ from the material properties of the body 102 of the sound insulating element 100. Preferably, a mode of the resonance frequency of each of the acoustic resonators 110 should essentially correspond to the desired frequency range, e.g. a compressional wave resonance, in which the body 102 of the sound insulating element 100 has a reduced sound insulating performance on its own.

An analytical estimate of the resonance frequency for the resonator 110 may be expressed as:

$$f = \frac{1}{2\pi}\sqrt{\frac{3E}{\rho h^2}}$$

where E, ρ and h are, respectively, the Young modulus, the material density, and the height of the resonator.

Accordingly, each resonator 110 may be configured differently to achieve a desired resonance frequency corresponding to that desired and dictated by the body 102 of the sound insulating element 100 it is to be associated with.

The resonators 110 are preferably manufactured from an elastomeric material such as silicone rubber or of a mineral fibre material such as glass wool. Other materials are however also possible as is elaborated further on below which meets the desired criteria in terms of providing resonators 110 with the desired shape and size that exhibits the desired resonance frequency according to the aforementioned.

In embodiments herein in which the resonators 110 are formed separately from the body 102 of the sound insulating element 100, each resonator 110 may be considered as a mass spring element and may thus be made of a stiff/dense material such as silicone rubber, wood or a metal such as aluminium, plaster and/or concrete. I.e. more stiff/dense than that the material of the body 102. Formed separately is to be interpreted as formed out of another material than the body 102 of the sound insulating element 100. Each resonator 110 may however be integrated into the rear surface portion 112 of the body 102 or attached over/to the rear surface 106 thereof.

Preferably, each resonator 110 may in such an embodiment have a Young's modulus higher than 100 MPa and a density larger than 200 kg/m$^3$.

Each resonator 110 may thus according to the foregoing considered a mass spring element whose 1$^{st}$ resonance frequency is tuned to the compressional wave resonance of the body 102.

Moreover, each resonator 110 may be of a homogenous material such as an elastic material, a viscoelastic material, a foam material, silicone rubber, wood, a metal such as aluminium, plaster, concrete and/or mineral wool. Alternatively, each resonator 110 may comprise an upper material layer being stiffer than a bottom material layer of each resonator 110. The material of the upper layer may be silicone rubber, wood, a metal such as aluminium, plaster and/or concrete. The bottom material layer, which is softer than the upper material layer, may be an elastic material, a viscoelastic material, a foam material and/or mineral wool.

Figure 2:
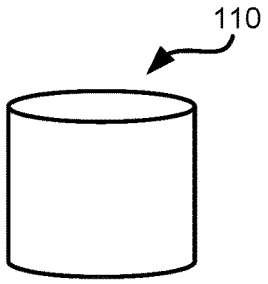
FIG. 2 discloses a perspective view of an acoustic resonator.
Figure 4:
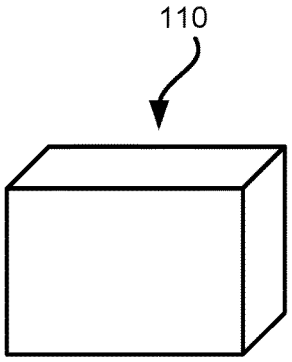
FIG. 4 discloses a perspective view of an acoustic resonator.

For a resonator 110 being provided with a cylindrical shape as shown in FIG. 2, the resonator may be between 3 mm and 20 mm in height and have a diameter between 3 mm and 20 mm. A resonator being provided with a rectangular block shape as shown in FIG. 4 may be between 3 mm and 20 mm in height and have a width in the longitudinal direction and the lateral direction of the body 102, respectively, between 3 mm and 20 mm.

The dimensions of the acoustic resonator 110 along with the material properties of thereof, such as the Youngs modulus E and the material density ρ, dictate the resonance frequency of the resonator 110. If the acoustic resonators 110 are made from mineral wool, these will need to be differently dimensioned to achieve the same resonance frequency as a silicone resonator 110 due to the differing material properties.

One example of an acoustic resonator may be a cylindrical silicone resonator having a height of 4.7 mm, a diameter of 5 mm, a Young's modulus of 0.4 MPa, a Poisson ratio of 0.45 and a density of 1000 kg/m$^3$ giving it a resonance frequency of approximately 1115 Hz.

Another example of an acoustic resonator may be a rectangular (cube-shaped) glass wool resonator having a height of 7 mm, a width of 9 mm, a Young's modulus of 0.1 MPa, a Poisson ratio of 0.3 and a density of 100 kg/m$^3$ giving it a resonance frequency of approximately 1142 Hz.

A further factor that may be modified for achieving the desired sound insulating properties of the sound insulating element 100 according to the teachings herein is the relationship between the mass of the body 102 and the combined mass of the plurality of acoustic resonators 110, i.e. the mass inclusion rate. The mass inclusion rate is defined as the combined mass of the plurality of acoustic resonators 110 divided by the mass of the body 102 of the sound insulating element 100.

Preferably, the acoustic resonators 110 should have a mass inclusion rate between 5% to 30% in relation to the mass of the body 102, as this provides desired sound insulation properties to the sound insulating element 100. The effect of the mass inclusion rate will be further elaborated on in relation to FIG. 8. The mass inclusion rate discussed in the foregoing is applicable to all embodiments disclosed herein.

Further still, and applicable to all embodiments disclosed herein, each acoustic resonator 110 may be configured to provide between 5% and 35% modal damping, preferably approximately 10% modal damping for the frequency range that is targeted for improving the insulation properties of the acoustic insulating element 100. In other words, each acoustic resonator 110 should preferably provide between 5% and 35% modal damping, preferably approximately 10% modal damping for the resonance frequency of each resonator 110 in the mode thereof that is used for energy pumping, i.e. for improving the insulating performance of the sound insulating element 100.

The damping and mechanical properties of the resonators 110 may measured according to ISO 18437.

As is shown in FIG. 1, the plurality of acoustic resonators 110 may be distributed in several parallel rows in the lateral and longitudinal direction of the sound insulating element 100. Each row may be provided with the same number of acoustic resonators 110 but other arrangements are naturally also possible.

Each longitudinal and/or lateral row of acoustic resonators 110 may also be displaced in the longitudinal or lateral direction of the sound insulating element 100 in relation to respective adjacent longitudinal and lateral rows of acoustic resonators 110.

The resonators 110 may further be randomly distributed.

It is also to be realized that fewer or more acoustic resonators 110 can be provided in each lateral and/or longitudinal row than what is shown in FIG. 1, and in each other embodiment of the sound insulating element 100 disclosed herein as well. Moreover, the resonators 110 may be provided with a different shape than the cylindrical shape shown in FIG. 1, they may for instance be rectangular block shaped, e.g. cuboid, as is illustrated in FIG. 4.

The resonators 110 may be formed integrally with the body 102 of the sound insulating element 100 in the same manufacturing process, for instance by providing mineral fibre with different properties (such as with different density) than the remainder of the body 102 for the portions that are to form acoustic resonators 110.

Figure 3:
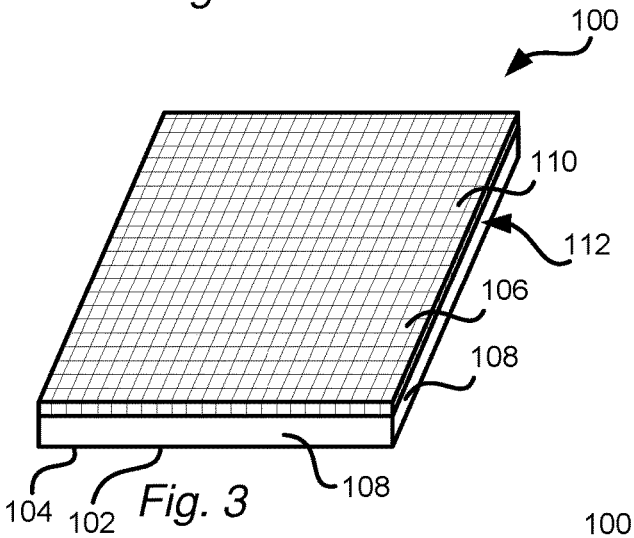
FIG. 3 discloses a perspective view of a sound insulating element.

FIG. 3 shows another embodiment of the acoustic insulating element 100 in a perspective view. In the embodiment shown in FIG. 3, the acoustic resonators 110 in the shape of cuboids are distributed over the rear surface 106 of the sound insulating element 100. The acoustic resonators 110 may, as mentioned, be formed integrally with the body 102 of the sound insulating element 100 or be separately formed and attached thereto for instance by means of an adhesive or a bonding process or by other suitable means. The acoustic resonators 110 may be formed integrally with the body 102, for instance as a layer with different material properties which is subsequently cut in a pattern to form the individual acoustic resonators 110 with the required shape and dimensions to achieve the desired resonance frequency.

Typically, for embodiments herein in which the resonators 110 are integral with the body 102 of the sound insulating element 100, each resonator 110 may be seen as a geometry such as for instance a beam (see embodiment of FIG. 5), the $1^{st}$ resonance frequency of which being tuned to the compressional wave resonance of the body 102 of the sound insulating element 100. Each resonator 110 may however be formed separately and then joined with the body 102 to form an integral unit, or be formed integrally with the body 102 in one or several subsequent manufacturing processes. Typically, the material of each resonator 110 for embodiments in which the aforementioned is applicable is an elastic material, a viscoelastic material, a foam material and/or a mineral wool material etc.

As is illustrated in FIG. 3, the spacing between the acoustic resonators 110 may be small. This may be required if for instance the acoustic resonators 110 are made from a material which requires more acoustic resonators 110 to achieve the desired mass inclusion rate of between 5% to 30%. It is also to be understood that the acoustic resonators 110 may be distributed such that for instance every second or third cuboid on the rear surface 106 is an acoustic resonator 110, while the remaining cuboids form part of the body 102.

Figure 5:
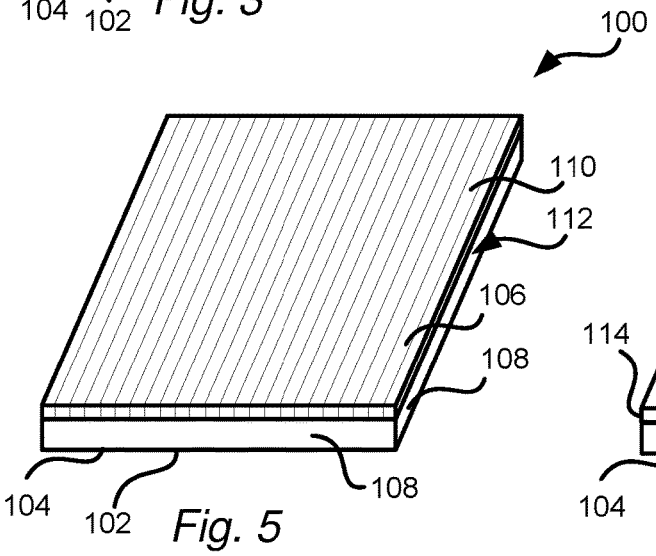
FIG. 5 discloses a perspective view of a sound insulating element.

Turning to FIG. 5, in which another embodiment of the acoustic sound insulating 100 is shown in a perspective view. In the embodiment of FIG. 5, each of the plurality of acoustic resonators 110 has an elongate cuboid shape such that the plurality of acoustic resonators 110 forms lamellas distributed in the rear surface portion 112 of the body 102 or over the rear surface 106 of the body 102. The lamella shaped acoustic resonators 110 are shown arranged over the body 102 of the sound insulating element 100, but may as mentioned be integrated in the rear surface portion 112 thereof or be formed in separate layer 114 (shown in FIG. 6).

The lamella shaped resonators 110 are shown extending longitudinally the full length of the body 102, it is however to be realized that each resonator 110 may extend only a portion of the longitudinal length of the body 102. Two or more lamella shaped resonators 110 may accordingly be arranged one after the other in the longitudinal direction of the body 102.

Figure 6:
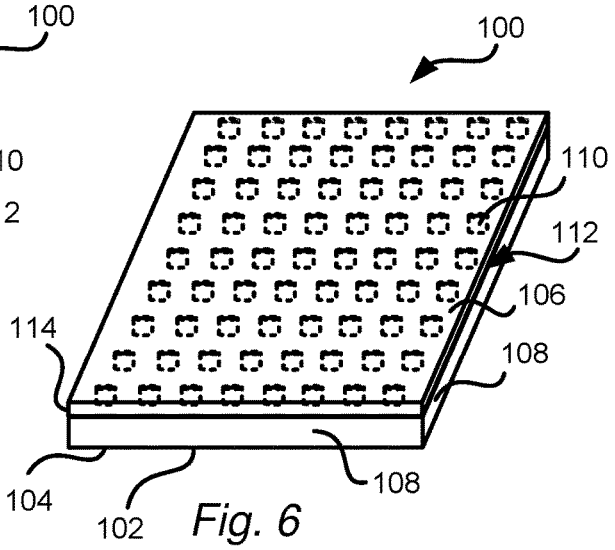
FIG. 6 discloses a perspective view of a sound insulating element.

FIG. 6 shows a further embodiment in which the plurality of acoustic resonators 110 is arranged on a layer 114 attached to the rear surface 106 of the body 102. The layer may be attached to the rear surface 106 for instance by means of an adhesive or by another suitable bonding process. The acoustic resonators 110 are illustrated as cylindrical resonators 110, but all embodiments of the resonators 110 disclosed herein could be arranged on a layer 114 attached to the rear surface 106 of the body 102.

The layer 114 comprising the acoustic resonators 110 could thus be separately manufactured, the material in the layer 114 surrounding the resonators 110 could be mineral fibre material such as glass wool or another suitable material.

Further still, the layer 114 and the resonators 110 may be integrally formed as a layer 114 having highly-orthotropic properties, thus forming regions which form the resonators 110 with the appropriate local resonances according to the foregoing.

The acoustic resonators 110 are shown as being integrated into the layer 114, it is however to be realized that they may be attached on the surface of the layer 114 as well.

Figure 7:
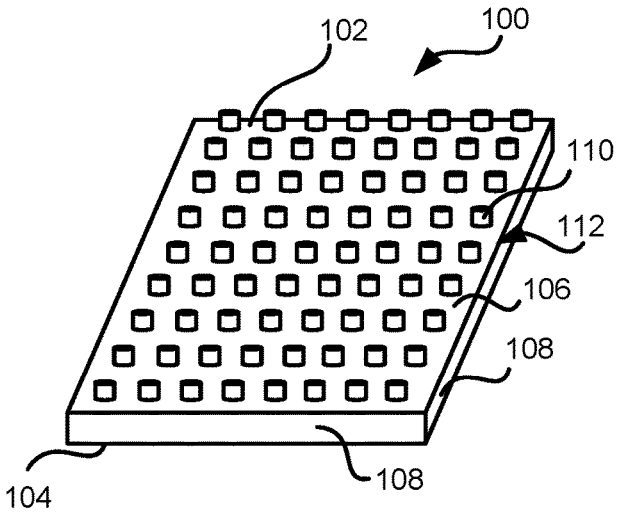
FIG. 7 discloses a perspective view of a sound insulating element.

FIG. 7 shows a perspective view of a sound insulating element 100 in which cylindrical acoustic resonators 110 are attached over the rear surface portion over the rear surface 106 of the body 102. The acoustic resonators 110 may be cylindrical as shown or have another shape such as cuboid as mentioned in the foregoing.

FIG. 8 discloses a diagram in which a prior art ceiling tile "Board "B" reference" is compared to different embodiments of the acoustic insulating element 100 disclosed herein. The plots show measured sound reduction index R(dB) over a frequency spectrum between 50 Hz and 5000 Hz in a controlled environment.

As is illustrated by the line for the prior art ceiling tile (i.e. reference board B) having a body without acoustic resonators, it suffers from a reduced performance in the frequency region between the 800 Hz and 2000 Hz, as is illustrated by the decrease in R(dB) in this region. The performance drop is due to a compressional wave resonance in the body of the ceiling tile. The resonance, which is independent of the transverse dimensions of the element, improves energy transfer through the ceiling tile and thus decreases the sound insulating performance.

A second line shows the performance of a sound insulating element 100 in which the reference board B is provided with 450 acoustic resonators 110 according to the teachings herein. The combined mass of the resonators 110 in relation to the mass of the body 102 of the reference board B provides a mass inclusion rate of 5%. For the targeted exemplary frequency interval of between 800 Hz and 2000 Hz, a significant improvement in R(dB) is achieved by the provision of the acoustic resonators 110.

With an increase in the mass inclusion rate to 10% and 20% respectively, a further increase in R(dB) is generated for the targeted frequency interval as is shown by the corresponding lines for the board with 870 resonators 110 and 1740 resonators 110 respectively. However, a balance between cost added by the acoustic resonators 110 and achieved beneficial effect may in some applications prevent high mass inclusion rates. I.e., even if 20% mass inclusion rate provides a slight advantage over a 10% mass inclusion rate and thus proves the concept, it may not be viable in terms of achieving a sound insulating element 100 that is competitive costwise in all market segments. I.e. a lower mass inclusion rate of approximately 10% may in some applications provide a balance between sound insulation performance and cost effectiveness for the sound insulating element 100.

Figure 9:
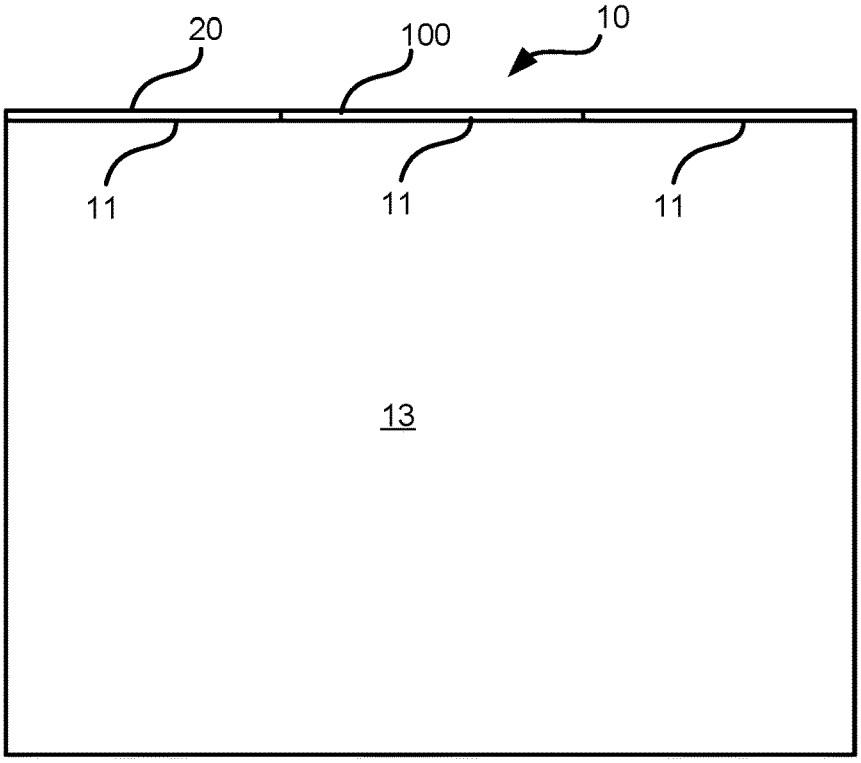
FIG. 9 discloses a schematic side view of a suspended ceiling system comprising a sound insulating element.

Turning now to FIG. 9, which shows a side view of a suspended ceiling system 10. The suspended ceiling system 10 is shown mounted in a room 13 and is configured to be suspended from a structural ceiling 20.

The suspended ceiling system 10 comprises a plurality of ceiling tiles 11, three are shown but naturally may more ceiling tiles 11 be provided as is realized by a person skilled in the art. At least one ceiling tile 11 is an acoustic sound insulating element 100. The suspended ceiling system 10 can be suspended from the structural ceiling 20 for instance by attaching each ceiling tile 11 individually to the structural ceiling 20. This may be desired in spaces with limited height to the structural ceiling 20, the suspended ceiling system 10 will thus only use a small amount of the available ceiling height while providing the desired functionality by the provision of the sound insulating element 100.

Naturally, all of the ceiling tiles 11 of the suspended ceiling system 10 may be sound insulating elements 100. At least should each sound insulating element 100 be suspended from the structural ceiling 20 such that the resonators 110 thereof are not in contact with the structural ceiling 20 as to not affect the resonance frequency thereof. Further still, the suspended ceiling system 10 is shown only comprising three ceiling tiles 11 for facilitating illustration, it is however to be realized that any number of ceiling tiles 11 may be provided.

Figure 10:
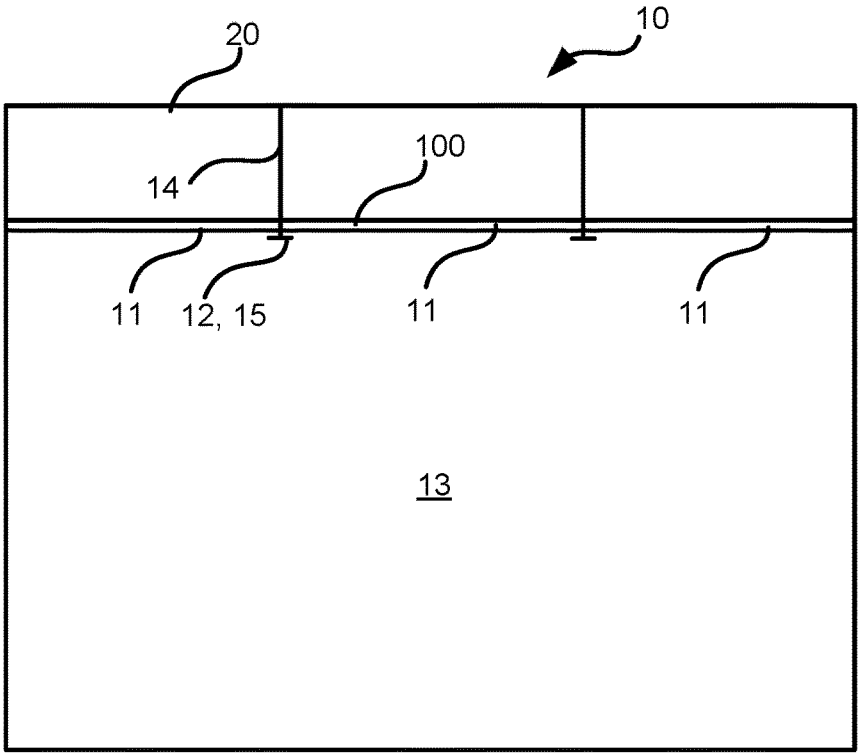
FIG. 10 discloses a schematic side view of a suspended ceiling system comprising a sound insulating element.

As is shown in FIG. 10, in which a suspended ceiling system 10 is shown in side view, the suspended ceiling tiles may be suspended by means of a grid of profiles 12. A grid of profiles 12 is a commonly used solution for attaching a suspended ceiling system 10 to a structural ceiling 12, and may be formed in a plurality of ways. Normally, the grid of profiles 12 comprises horizontal members 15 forming a grid which is formed such that each ceiling tile 11 is supported along its perimeter. The horizontal members 15 are attached to the structural ceiling 20 by means of a number of vertical members 14, which carry at least a part of the weight of the suspended ceiling system 10. The horizontal members 15 may in addition or alternatively be supported by one or several walls in the room 13.

The length of the vertical members 14 may be varied to achieve a desired placement of the ceiling tiles 11. Alternatively, the vertical members 14 may be omitted and the horizontal members 15 can be attached directly to the structural ceiling 20. The grid of profiles 12 may be attached in a plurality of ways to the structural ceiling 20 and/or to one or several walls in the room as is realized by a person skilled in the art.

The space between the ceiling tiles 11 and the structural ceiling 20 forms a plenum space and may contain ventilation ducts, electrical wiring etc.

The suspended ceiling system 10 can by the provision of sound insulating elements 100 thereto provide improved sound insulating properties, as the inherent resonance frequencies of the bodies 102 of the ceiling tiles 11 can be compensated for by the provision of the plurality of acoustic resonators 110.

It will be appreciated that the present invention is not limited to the embodiments shown. Several modifications and variations are thus conceivable within the scope of the invention which thus is exclusively defined by the appended claims.

The invention claimed is:

1. A sound insulating element comprising:

a body made of a mineral fibre material and having a single layer structure and acoustically insulating properties, the body comprising a front surface, a rear surface, and a side surface connecting the front and rear surfaces; and a plurality of acoustic resonators distributed in a rear surface portion of the body or over the rear surface of the body, wherein the plurality of acoustic resonators has a mass inclusion rate between 5% to 30% in relation to a mass of the body, and wherein each resonator is configured to have a resonance frequency essentially corresponding to a compressional wave frequency of the body, and wherein each of the plurality of acoustic resonators has a cylindrical or cuboid shape.

2. The sound insulating element according to claim 1, wherein the plurality of acoustic resonators is evenly distributed.

3. The sound insulating element according to claim 1, wherein the plurality of acoustic resonators is made of an elastomeric material or of a mineral fibre material.

4. The sound insulating element according to claim 1, wherein the plurality of acoustic resonators is made of silicone rubber or of glass wool.

5. The sound insulating element according to claim 1, wherein each of the plurality of acoustic resonators has an elongate cuboid shape such that the plurality of acoustic resonators forms lamellas distributed in the rear surface portion of the body or over the rear surface of the body.

6. The sound insulating element according to claim 1, wherein the plurality of acoustic resonators is arranged on a layer attached to the rear surface of the body.

7. The sound insulating element according to claim 1, wherein the plurality of acoustic resonators is attached to the body by an adhesive.

8. The sound insulating element according to claim 1, wherein each of the plurality of acoustic resonators has a resonance frequency in the range of 100 Hz to 2500 Hz.

9. The sound insulating element according to claim 1, wherein each of the plurality of acoustic resonators has a resonance frequency in the range of 300 Hz to 2500 Hz.

10. A suspended ceiling system configured to be suspended from a structural ceiling, the suspended ceiling system comprising:

a plurality of ceiling tiles, wherein at least one of the ceiling tiles is the sound insulating element according to claim 1.

11. The suspended ceiling system according to claim 10, further comprising a grid of profiles supporting the plurality of ceiling tiles.

12. The sound insulating element according to claim 1, wherein the mineral fibre of the body is glass or stone wool.

13. The sound insulating element according to claim 1, wherein each of the plurality of acoustic resonators has a Young's modulus higher than 100 MPa and a density larger than 200 $kg/m^3$.

14. The sound insulating element according to claim 1, wherein each of the plurality of acoustic resonators has an upper layer and a bottom layer, and a material of the upper layer is stiffer than a material of the bottom layer.

15. The sound insulating element according to claim 1, wherein each of the plurality of acoustic resonators is configured to provide between 5% and 35% modal damping.

16. The sound insulating element according to claim 1, wherein each of the plurality of acoustic resonators has 10% modal damping for the resonance frequency.

* * * * *